US009885275B2

(12) United States Patent
Kurata

(10) Patent No.: US 9,885,275 B2
(45) Date of Patent: Feb. 6, 2018

(54) BOILING COOLING SYSTEM

(71) Applicant: HONDA MOTOR CO., LTD., Tokyo (JP)

(72) Inventor: Mashu Kurata, Tokyo (JP)

(73) Assignee: HONDA MOTOR CO, LTD., Tokyo (JP)

( * ) Notice: Subject to any disclaimer, the term of this patent is extended or adjusted under 35 U.S.C. 154(b) by 46 days.

(21) Appl. No.: 15/009,353

(22) Filed: Jan. 28, 2016

(65) Prior Publication Data

US 2016/0258344 A1 Sep. 8, 2016

(30) Foreign Application Priority Data

Mar. 5, 2015 (JP) ..... 2015-043388

(51) Int. Cl.
*F28D 15/00* (2006.01)
*F01P 11/02* (2006.01)
*F01P 3/22* (2006.01)

(52) U.S. Cl.
CPC ..... *F01P 11/0295* (2013.01); *F01P 3/2285* (2013.01)

(58) Field of Classification Search
CPC ..... F01P 11/0295; F01P 3/2285; F02M 11/02
USPC ..... 165/104.21
See application file for complete search history.

(56) References Cited

U.S. PATENT DOCUMENTS 5,080,167 A * 1/1992 Wolf ..... B60H 1/3227 165/140
5,353,751 A * 10/1994 Evans ..... F01M 11/02 123/41.01
5,381,762 A * 1/1995 Evans ..... F01M 11/02 123/41.29
6,371,742 B1 4/2002 Gigon

FOREIGN PATENT DOCUMENTS

DE 42 22 913 A1 1/1994
JP 5-47352 U 6/1993
JP 2002-500319 A 1/2002

* cited by examiner

*Primary Examiner* — Davis Hwu
(74) *Attorney, Agent, or Firm* — Westerman, Hattori, Daniels & Adrian, LLP

(57) ABSTRACT

Provided is a compact boiling cooling system for an internal combustion engine that can operate in a stable manner. A lower end (4*c*) of a water jacket (4) of an engine (1) is connected to a lower tank (7*c*) of a radiator (7), and an upper end (4*d*) of a water jacket is connected to an upper part (7*a*) of the radiator. A substantially entire part of the radiator is located above the upper end of the coolant jacket so that the boiling cooling water is forwarded from the upper end of the water jacket to the upper part of the radiator, and the cooling water condensed in the radiator is forwarded from the lower end of the radiator to the lower end of the water jacket under the gravitational force without requiring a pump.

6 Claims, 3 Drawing Sheets

BOILING COOLING SYSTEM

TECHNICAL FIELD

The present invention relates to a boiling cooling system, and in particular to a boiling cooling system for use in an internal combustion engine.

BACKGROUND ART

The cooling system for an internal combustion system is typically cooled either by water (or a liquid coolant) or air. An air cooled engine is relatively economical to build because of a smaller number of components that are required. A water cooled engine typically employs a water pump to circulate water in the water jacket of the engine, a radiator to cool the water from the water jacket and a thermostat to regulate the flow of water in the water jacket to maintain the temperature of the cooling water at a prescribed level. Thus, a water cooled engine has the advantage of cooling the engine in a stable manner, but has the drawback of requiring a relatively large number of component parts. Therefore, a water cooled engine is usually more expensive to build and larger in size than a comparable air cooled engine.

In recent years, internal combustion engines known as controlled autoignition (CAI) engines have come to be realized as an attractive option because of the lean stoichiometries at which such engines can operate, and the associated low NOx emissions. For a CAI engine to operate in a satisfactory manner, it is desirable to quickly raise the temperature of the coolant to a prescribed temperature at the time of startup while preventing the coolant temperature from becoming excessive. Therefore, a water cooled engine that allows an accurate temperature control may be suited for a CAI engine, but has the drawback of requiring a significant time period for the engine to warm up so that the engine may not operate in a stable manner for a considerable time period until the engine fully warms up.

Based on such considerations, the inventor of this application has recognized that the boiling cooling system may be a suitable cooling system for a CAI engine because the boiling cooling system requires a relatively small number of components, and can reach a steady state in a relatively short period of time. In the boiling cooling system, because the upper limit of the coolant temperature is determined by the boiling point of the coolant, the need for a thermostat or other temperature control devices is eliminated. However, in order to achieve a compact CAI engine design that is suitable for a small general purpose engine, the cooling system is required to be designed as a compact unit.

In a known boiling cooling system disclosed in JPH05-47352U, a gas/liquid separator that is normally used in a boiling cooling system is omitted, and the radiator is tilted rearward so that the gas/liquid separation may take place within the radiator. However, a pump is required to recirculate the coolant. Therefore, there is a demand to further simplify the boiling cooling system for internal combustion engines.

SUMMARY OF THE INVENTION

In view of such problems of the prior art and the recognition by the inventor, a primary object of the present invention is to provide a compact boiling cooling system for an internal combustion engine.

A second object of the present invention is to provide a boiling cooling system for an internal combustion engine that can operate in a stable manner.

To achieve such objects, the present invention provides a boiling cooling system for an internal combustion engine (1), comprising: a coolant jacket (4) provided in the engine; a radiator (7); a coolant liquid passage (5) communicating a lower part of the coolant jacket with the radiator; and a coolant vapor passage (6) communicating an upper part of the coolant jacket with the radiator; wherein a coolant liquid that has boiled into a coolant vapor in the coolant jacket is forwarded to the radiator via the coolant vapor passage, and the coolant vapor that has condensed into a coolant liquid is returned to the coolant jacket via the coolant liquid passage; and wherein a substantially entire part of the radiator is located above an upper end of the coolant jacket.

Thereby, the coolant is boiled in the coolant jacket to be forward as a coolant vapor to the radiator while the liquid coolant condensed in the radiator is transported back to the coolant jacket under the action of the gravity so that the coolant can be recirculated through the coolant jacket and the radiator without using a pump. As a result, the number of necessary component parts can be reduced, the structure of the cooling system can be simplified, and the size of the cooling system can be minimized.

Typically, the coolant liquid passage is connected to a lower part of the radiator, and the coolant vapor passage is connected to an upper part of the radiator.

Thereby, the entire length or the height of the radiator can be utilized for cooling the coolant vapor, and the cooling efficiency can be improved. If desired, a gas/liquid separator may be provided in the coolant vapor passage to allow any liquid component of the coolant to bypass the radiator, and to be directly forwarded to the coolant liquid passage so that an even higher cooling efficiency may be achieved.

If desired, the radiator may be tilted rearward. Thereby, the coolant vapor is conducted along the upwardly facing front side of the radiator while the coolant liquid is conducted along the rearwardly facing rear side of the radiator so that the coolant vapor and the coolant liquid are separated from each other in the radiator without requiring a separate air/liquid separator, and a high cooling efficiency can be achieved with a highly simple structure.

Preferably, a liquid level of the coolant liquid received in the radiator is located above the upper end of the coolant jacket.

Thereby, the coolant liquid is allowed to flow from the radiator to the coolant jacket under the action of the gravity, and it can be ensured that the coolant jacket is always filled with the coolant liquid.

Preferably, the radiator includes a radiator core (7*b*) and a lower tank (7*c*) located at a lower end of the radiator core to receive the coolant liquid condensed in the radiator core, and an upper end of the lower tank is located above the upper end of the coolant jacket so that a conventional radiator may be used for the present invention.

According to a preferred embodiment of the present invention, the lower tank is tapered in a downward direction, and a lower end of the lower tank is connected to a corresponding end of the coolant liquid passage.

Thereby, the condensed coolant liquid converges to the coolant liquid passage with a minimum flow resistance and without causing any stagnation as the coolant liquid is recirculated back to the coolant jacket.

Preferably, the radiator is tilted rearward, and the coolant vapor passage is connected to the lower tank.

Thereby, the boiling coolant liquid that is introduced from the coolant jacket into the lower tank is passed through the coolant liquid stored in the lower tank before moving upward into the radiator core. During this process, the coolant vapor is separated from the boiling coolant liquid, and moves upward in the radiator core along the upwardly facing front side of the radiator. The coolant vapor then condenses in the radiator core, and the condensate flows downward along the downwardly facing rear side of the radiator. Therefore, the coolant vapor and the coolant liquid are allowed to flow in the radiator core in a mutually separated manner so that a high cooling efficiency of the radiator core is ensured, and an undesired pressure rise in the radiator can be avoided.

According to a particularly preferred embodiment of the present invention, the coolant vapor passage is connected to an upwardly facing front side of the lower tank.

Owing to this arrangement, the separation between the coolant vapor and the coolant liquid can be accomplished in an even more favorable manner.

Thus, according to the present invention, the coolant can be recirculated in the radiator and the coolant jacket of the engine without requiring a coolant pump so that the number of necessary component parts can be minimized, and the boiling cooling system can be designed as a highly compact unit.

DETAILED DESCRIPTION OF THE PREFERRED EMBODIMENT(S)

Figure 1:
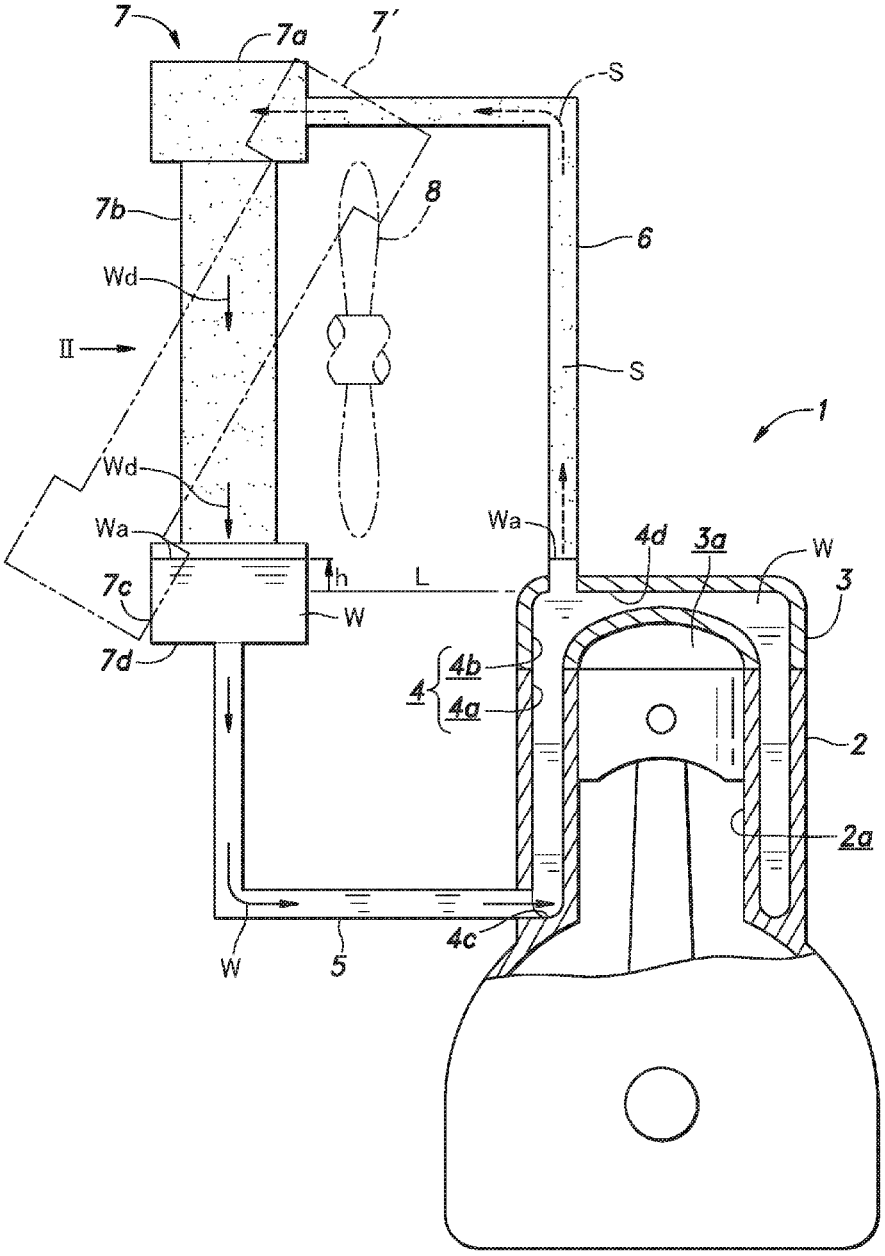
FIG. 1 is a diagram showing a boiling cooling system embodying the present invention.

Preferred embodiments of the present invention are described in the following with reference to the appended drawings. FIG. 1 is a diagram showing a boiling cooling system embodying the present invention. The boiling cooling system of the illustrated embodiment is applied to a small general purpose engine consisting of a two stroke, single cylinder engine 1. However, the present invention is not limited to such an engine, but may be applied to any liquid cooled engine with multiple cylinders. The engine may also be either a two stroke or four stroke type. The engine of the illustrated embodiment has a vertical cylinder axial line, but the present invention may be applied to engines that are used in any other different orientations.

The engine 1 is provided with a cylinder block 2 and a cylinder head 3. The cylinder head 3 is attached to the cylinder block 2 via a gasket by using head bolts. The cylinder block 2 internally defines a cylinder 2*a*, and the cylinder head 3 internally defines a combustion chamber 3*a* in cooperation with the cylinder block 2 and a piston slidably received in the cylinder 2*a*. The cylinder block 2 is provided with a cylinder water jacket 4*a* surrounding the cylinder 2*a*, and the cylinder head 3 is provided with a combustion chamber water jacket 4*b* surrounding the combustion chamber 3*a*. The cylinder water jacket 4*a* and the combustion chamber water jacket 4*b* communicate with each other so that a coolant W typically consisting of a cooling water mixed with additives circulates therein. In the following description, the cylinder water jacket 4*a* and the combustion chamber water jacket 4*b* may be collectively referred to as the "water jacket 4".

The water jacket 4 is connected to a radiator 7 via a coolant liquid pipe 5 and a coolant vapor pipe 6. The coolant is circulated between the jacket 4 and the radiator 7 via the coolant liquid pipe 5 and the coolant vapor pipe 6. These pipes 5 and 6 typically consist of flexible hoses.

The radiator 7 of the illustrated embodiment is used in an upright orientation, and includes an upper tank 7*a*, a radiator core 7*b* and a lower tank 7*c* such that the upper tank 7*a* communicates with the lower tank 7*c* via the radiator core 7*b* in a per se known manner. An electric cooling fan 8 is provided behind the radiator 7 to cool the radiator 7 by conducting an air flow through the radiator core 7*b* in cooperation with a radiator shroud not shown in the drawings.

The coolant liquid pipe 5 is connected between the lower tank 7*c* and the cylinder water jacket 4*a*, and the coolant vapor pipe 6 is connected between the combustion chamber water jacket 4*b* and the upper tank 7*a*. In particular, the coolant liquid pipe 5 is connected to a lower end 4*c* of the water jacket 4 (cylinder water jacket 4*a*), and the coolant vapor pipe 6 is connected to an upper end 4*d* of the water jacket 4 (combustion chamber water jacket 4*b*). The lower end 4*c* of the water jacket 4 is not required to be the lowest end of the water jacket 4, but may be located in a relatively low part thereof. Likewise, the upper end 4*d* of the water jacket 4 is not required to be the highest end of the water jacket 4, but may be located in a relatively high part thereof.

During the operation of the engine 1, the coolant W in the water jacket 4 boils on the wall surface adjoining the combustion chamber 3*a* in which combustion heat is generated, and an active heat transfer in the form of latent heat takes place owing to this boiling. The coolant vapor S generated from this boiling is transported to the upper tank 7*a* of the radiator 7 via the coolant vapor pipe 6.

The coolant vapor S transported to the upper tank 7*a* flows downward in the radiator core 7*b*, and condenses therein. The condensate of the coolant W drops into the lower tank 7*c* as indicated by arrows Wd in FIG. 1, and is stored therein as coolant liquid W.

The liquid level Wa of the coolant liquid W in the radiator 7 is typically located slightly below (or at a substantially same level as) the upper end of the lower tank 7*c* (immediately below the lower end of the radiator core 7*b*), and is higher than a level L of an upper end 4*d* of the water jacket 4 by a distance h. At any event, the cooling system is configured such that the liquid level Wa of the coolant liquid W in the radiator 7 is slightly higher than the level L of the upper end 4*d* of the water jacket 4 by appropriately determining the quantity of the coolant liquid W and the positioning of the water jacket 4, the radiator 7, the coolant liquid pipe 5 and the coolant vapor pipe 6. Alternatively, the liquid level Wa of the coolant liquid W in the radiator 7 may be at a substantially same level as the upper end 4*d* of the lower tank 7*c*.

Thus, the coolant vapor S is condensed in a substantially entire part of the radiator core 7*b* of the radiator 7 so that the cooling efficiency may be optimized. Because the liquid level Wa of the coolant liquid W stored in the lower tank 7*c* is slightly higher than the upper end 4*d* of the water jacket 4, the coolant liquid W in the radiator 7 is allowed to spontaneously flow into the water jacket 4 so that a deficiency of the coolant liquid W in the water jacket 4 can be avoided, and a natural circulation of the coolant liquid W in the radiator 7 and the water jacket 4 can be promoted.

Optionally, the coolant vapor pipe 6 may be provided with a gas/liquid separator not shown in the drawing to separate a liquid component from the coolant vapor to be directly forwarded to the coolant liquid pipe 5 so as to bypass the radiator. Thereby, the liquid component of the coolant is prevented from flowing through the radiator core 7*b* so that the cooling efficiency of the radiator 7 may be improved.

If desired, the radiator 7' may be tilted rearward as indicated by the imaginary lines. Thereby, the coolant vapor is conducted along the upwardly facing front side of the radiator 7' while the coolant liquid is conducted along the rearwardly facing rear side of the radiator 7' so that the coolant vapor and the coolant liquid are separated from each other in the radiator 7' without requiring a separate air/liquid separator, and a high cooling efficiency can be achieved with a highly simple structure.

Figure 2:
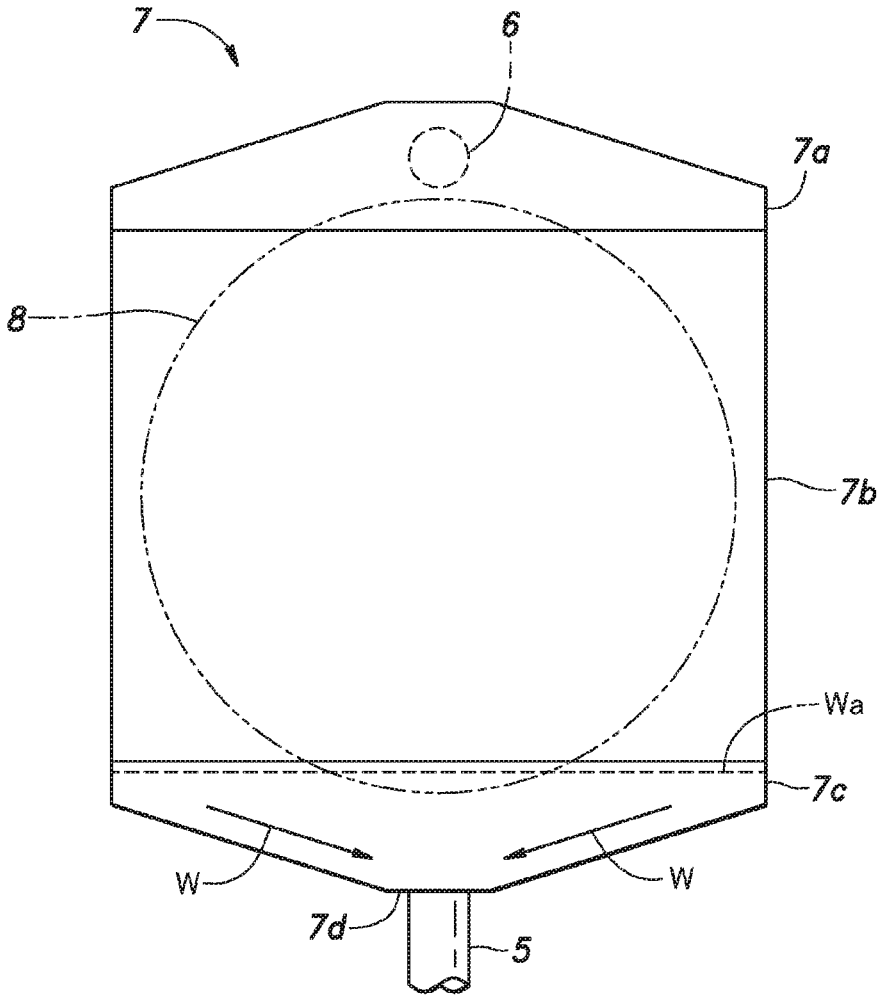
FIG. 2 is a simplified front view of the radiator as seen in the direction indicated by arrow II in FIG. 1.

FIG. 2 is a simplified front view of the radiator 7 as seen in the direction indicated by arrow II in FIG. 1. As shown in this drawing, the lower tank 7*c* of the radiator 7 is tapered such that the lateral width thereof decreases in the downward direction. In the illustrated embodiment, the lower tank 7*c* is provided with the shape of an inverted triangle in front view while the fore and aft dimension thereof is substantially uniform. Alternatively, the fore and aft dimension of the lower tank 7*c* may diminish in the downward direction while the lateral dimension thereof is substantially uniform. It is also possible to have the lower tank 7*c* taper in the downward direction as seen both in side view and in front view.

Owing to the downwardly tapering shape of the lower tank 7*c,* the coolant liquid W stored in the lower tank 7*c* converges to the center or the lower end 7*d* of the lower tank 7*c* as the coolant liquid W flows downward as indicated by arrows W in FIG. 2. The lower end 7*d* is connected to the corresponding end of the coolant liquid pipe 5. Thus, owing to the tapering shape of the lower tank 7*c,* the coolant liquid W is allowed to flow smoothly (with a minimum flow resistance and a least stagnation) into the coolant liquid pipe 5 without stagnating so that the coolant liquid W is supplied to the water jacket 4 in a stable manner.

In this boiling cooling system, the coolant liquid W can be spontaneously circulated between the radiator 7 and the water jacket 4 without requiring a coolant pump. Owing to the elimination of the need for a coolant pump, the cooling system can be designed as a simple and compact system requiring a minimum number of component parts, and this makes the cooling system highly suitable for use in small general purpose engines.

In particular, in the case of CAI (controlled autoignition) engines, it is necessary to quickly raise the temperature of the coolant to an appropriate level at the time of startup. The boiling cooling system of the present invention is particularly suitable for such an application because the temperature of the coolant can be stabilized in a relatively short period of time. As a result, the combustion process of the engine can be performed in a stable manner. Also, the temperature of the coolant in the boiling cooling system of the present invention is maintained substantially at the boiling point of the coolant so that the temperature of the coolant can be maintained at the fixed level without requiring a thermostat or any other temperature regulating devices. As a matter of fact, the temperature variation of the coolant in the boiling cooling system is less than that in the more conventional cooling system using a thermostat for temperature control.

Figure 3:
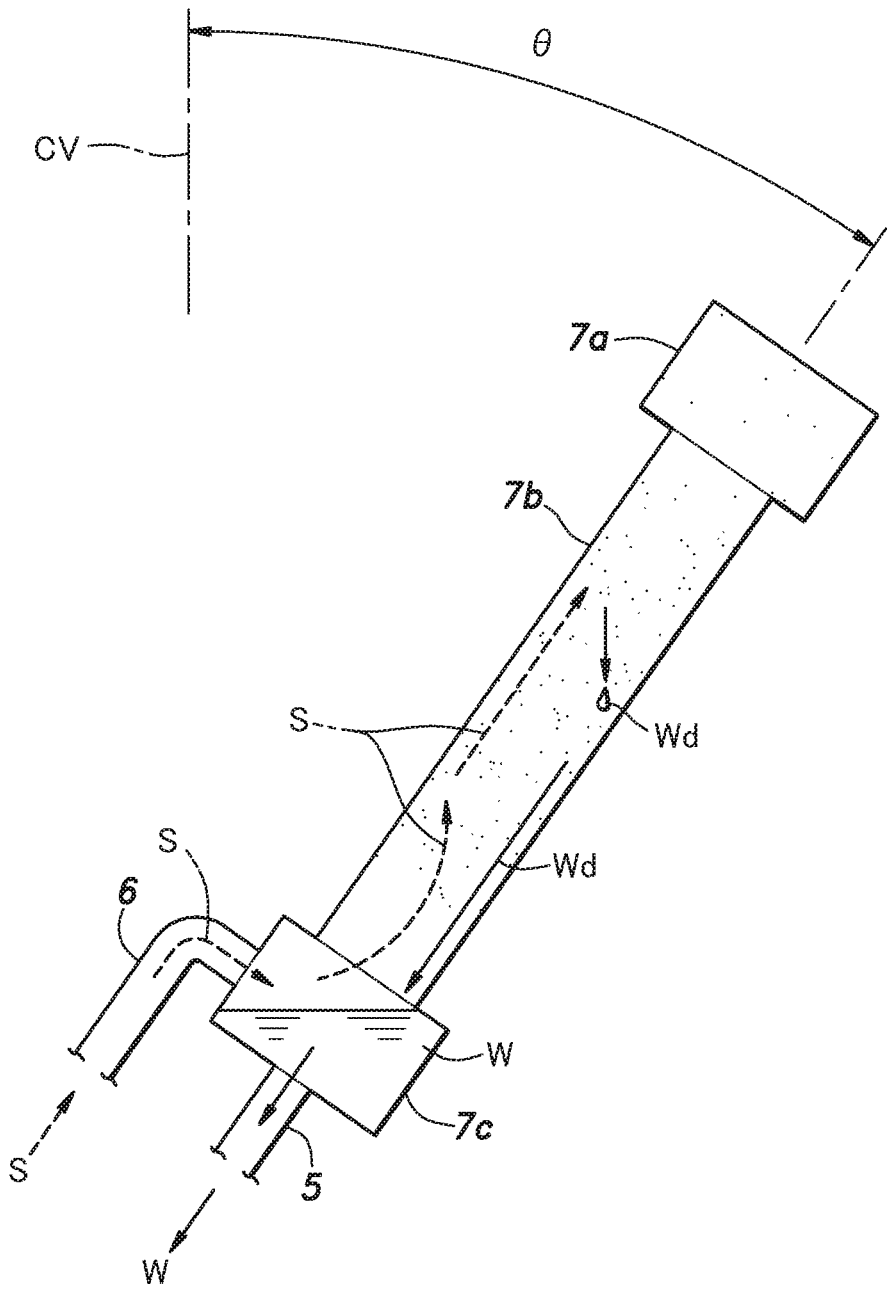
FIG. 3 is a side view of the radiator of a second embodiment of the present invention.

FIG. 3 is a side view of the radiator 7 of a second embodiment of the present invention. In the description of the second embodiment, the parts corresponding to those of the first embodiment are denoted with like numerals without necessarily repeating the description of such parts.

In this embodiment, the radiator 7 is tilted rearward by an angle θ with respect to a plumb vertical line CV such that the upper tank 7*a* is positioned more rearward than the lower tank 7*c*. This rearward tilt angle θ may be in the range of 0 to 60 degrees, and more preferably in the range of 30 to 60 degrees.

Furthermore, in this embodiment, the coolant vapor pipe 6 is connected to the lower tank 7*c* (instead of the upper tank 7*a*), and in particular to the front end of the lower tank 7*c* which is raised higher than the rear end thereof owing to the rearward tilting of the radiator 7. The front end of the lower tank 7*c* to which the coolant vapor pipe 6 is connected faces somewhat upward owing to the rearward tilting of the radiator 7.

In the lower tank 7*c,* the coolant vapor S and the coolant liquid W coexist, and the coolant vapor S supplied from the coolant vapor pipe 6 is passed into the radiator core 7*b* via an upper part of the lower tank 7*c* while the condensed coolant dripping from the radiator core 7*b* is received into the coolant liquid W in the lower part of the lower tank 7*c*.

If a part of the coolant liquid W were introduced into the radiator core 7*b* along with the coolant vapor S supplied from the coolant vapor pipe 6, the cooling efficiency of the radiator 7 would drop, and the pressure in the radiator core 7*b* would rise. On the other hand, according to the second embodiment, the coolant liquid W that may be entrained in the coolant vapor S that is forwarded to the radiator 7 is separated from the coolant vapor S in the lower tank 7*c,* and substantially only the coolant vapor S is allowed to be introduced into the radiator core 7*b*. Thereby, the coolant vapor S can be cooled in the radiator core 7*b* in an efficient manner. Thus, the condensation of the coolant vapor S in the radiator core 7*b* is performed in an efficient manner so that the pressure rise in the radiator core 7*b* can be avoided, and the cooling performance of the radiator 7 based on the boiling cooling process can be improved.

As shown by the broken line arrows in FIG. 3, the coolant vapor S that moves upward in the radiator core 7*b* is directed to the upper part of the rearwardly tilted radiator core 7*b*. Because the cooling air drawn by the cooling fan 8 first impinges upon the front and upwardly facing side of the radiator core 7*b,* the coolant vapor S that flows along the upwardly facing front side is preferentially cooled. Therefore, a high cooling efficiency can be achieved. The condensate of the coolant vapor S drops onto the downwardly facing rear side of the radiator core 7*b,* and flows along the inclined path on the rear face of the radiator core 7*b*. Because the front and rear parts of the radiator core 7*b* in which the coolant vapor S and the coolant liquid W respectively flow are clearly separated, the reduction in the cooling efficiency due to the mixing of the liquid and gas phases can be avoided.

The present invention has been described in terms of specific embodiments, but the present invention is not limited by such embodiments, and various modifications can be made to the illustrated embodiments without departing from the spirit of the present invention. For instance, in the second embodiment, the upper tank 7*a* may be omitted so that the upper end of the radiator 7 may simply consist of a closed end of the radiator core 7*b* which typically consists of a tube and fin radiator core.

The invention claimed is:

1. A boiling cooling system for an internal combustion engine, comprising:

a coolant jacket provided in the engine;

a radiator;

a coolant liquid passage communicating a lower part of the coolant jacket with the radiator; and a coolant vapor passage communicating an upper part of the coolant jacket with the radiator;

wherein a coolant liquid that has boiled into a coolant vapor in the coolant jacket is forwarded to the radiator via the coolant vapor passage, and the coolant vapor that has condensed into a coolant liquid is returned to the coolant jacket via the coolant liquid passage;

wherein a substantially entire part of the radiator is located above an upper end of the coolant jacket;

wherein the coolant liquid passage is connected to a lower part of the radiator;

wherein the radiator includes a radiator core and a lower tank located at a lower end of the radiator core to receive the coolant liquid condensed in the radiator core, and an upper end of the lower tank is located above the upper end of the coolant jacket; and wherein the radiator is tilted rearward, and the coolant vapor passage is connected to the lower tank.

2. The boiling cooling system according to claim 1, wherein a liquid level of the coolant liquid received in the radiator is located above the upper end of the coolant jacket.

3. The boiling cooling system according to claim 1, wherein the lower tank is tapered in a downward direction, and a lower end of the lower tank is connected to a corresponding end of the coolant liquid passage.

4. The boiling cooling system according to claim 1, wherein the coolant vapor passage is connected to an upwardly facing front side of the lower tank.

5. The boiling cooling system according to claim 1, further comprising a cooling fan disposed behind the radiator.

6. The boiling cooling system according to claim 1, wherein a rearward tilt angle of the radiator with respect to a plumb vertical line is in a range of 0 to 60 degrees.

* * * * *